US012702171B2

(12) United States Patent
Moloney

(10) Patent No.: US 12,702,171 B2
(45) Date of Patent: Aug. 11, 2026

(54) SYSTEM AND METHOD OF AEROSOL DELIVERY

(71) Applicant: Nicoventures Trading Limited, London (GB)

(72) Inventor: Patrick Moloney, London (GB)

(73) Assignee: Nicoventures Trading Limited, London (GB)

( * ) Notice: Subject to any disclaimer, the term of this patent is extended or adjusted under 35 U.S.C. 154(b) by 799 days.

(21) Appl. No.: 17/769,662

(22) PCT Filed: Sep. 17, 2020

(86) PCT No.: PCT/GB2020/052250
§ 371 (c)(1),
(2) Date: Apr. 15, 2022

(87) PCT Pub. No.: WO2021/074582
PCT Pub. Date: Apr. 22, 2021

(65) Prior Publication Data

US 2023/0146370 A1 May 11, 2023

(30) Foreign Application Priority Data

Oct. 16, 2019 (GB) ..... 1914952

(51) Int. Cl.
*A24F 40/65* (2020.01)
*A24F 40/53* (2020.01)
*A24F 40/57* (2020.01)

(52) U.S. Cl.
CPC ..... *A24F 40/65* (2020.01); *A24F 40/53* (2020.01); *A24F 40/57* (2020.01)

(58) Field of Classification Search
None
See application file for complete search history.

(56) References Cited

U.S. PATENT DOCUMENTS

2014/0190496 A1 7/2014 Wensley et al.
2016/0338407 A1 11/2016 Kerdemelidis
(Continued)

FOREIGN PATENT DOCUMENTS

CN 109123809 A 1/2019
CN 209073555 U 7/2019
(Continued)

OTHER PUBLICATIONS

International Preliminary Report on Patentability and Written Opinion for Application No. PCT/GB2020/052250, mailed on Apr. 28, 2022, 8 pages.
(Continued)

*Primary Examiner* — Paul B Yanchus, III
(74) *Attorney, Agent, or Firm* — Burr & Forman

(57) ABSTRACT

A computing device configured to communicate with an aerosol provision device is disclosed. The computing device is configured to obtain at least part of a data set comprising data indicative of a mood of a user of the aerosol provision device as a function of a predetermined variable, calculate, on the basis of at least part of the data and a current value of the predetermined variable, an adjustment to one or more operational parameters for controlling the operation of an aerosol provision device of the user, and provide the calculated adjustment of the one or more operational parameters to the aerosol provision device of the user.

17 Claims, 4 Drawing Sheets

(56) References Cited

U.S. PATENT DOCUMENTS

| | | | | |
|---|---|---|---|---|
| 2017/0086505 | A1 | 3/2017 | Cameron | |
| 2017/0135411 | A1 | 5/2017 | Cameron | |
| 2017/0367651 | A1 | 12/2017 | Tzvieli et al. | |
| 2018/0071425 | A1 | 3/2018 | Jin et al. | |
| 2018/0092595 | A1 | 4/2018 | Chen et al. | |
| 2019/0027240 | A1 | 1/2019 | Davidson et al. | |
| 2019/0053540 | A1 | 2/2019 | Baker et al. | |
| 2019/0167927 | A1* | 6/2019 | Dagnello | G06N 20/00 |
| 2020/0329766 | A1* | 10/2020 | Doyle | A24F 40/50 |
| 2020/0352249 | A1* | 11/2020 | Achtien | A61M 15/0066 |

FOREIGN PATENT DOCUMENTS

| | | | |
|---|---|---|---|
| CN | 110200328 | A | 9/2019 |
| CN | 110226776 | A | 9/2019 |
| CN | 112120298 | A | 12/2020 |
| CN | 215075499 | U | 12/2021 |
| JP | 2018534909 | A | 11/2018 |
| JP | 2018536388 | A | 12/2018 |
| JP | 2018538711 | A | 12/2018 |
| JP | 2020513241 | A | 5/2020 |
| RU | 2162724 | C2 | 2/2001 |
| RU | 2680224 | C2 | 2/2019 |
| WO | WO-2014195805 | A2 | 12/2014 |
| WO | WO-2015175701 | A1 | 11/2015 |
| WO | WO-2016141147 | A1 | 9/2016 |
| WO | WO-2016187110 | A1 | 11/2016 |
| WO | 2017032873 | A2 | 3/2017 |
| WO | 2018098371 | A1 | 5/2018 |
| WO | WO-2018108582 | A1 | 6/2018 |
| WO | 2018135887 | A1 | 7/2018 |
| WO | WO-2018146453 | A1 | 8/2018 |
| WO | 2019141577 | A1 | 7/2019 |
| WO | 2020187948 | A1 | 9/2020 |

OTHER PUBLICATIONS

Office Action mailed Sep. 2, 2022 for Russian Application No. 2022110185, 17 pages.

Translation of Office Action issued in corresponding Japanese Application No. 2022-522947 on May 7, 2024, all enclosed pages.

International Search Report and Written Opinion for Application No. PCT/GB2020/052250, mailed on Nov. 30, 2020, 13 pages.

Communication Pursuant to Article 94(3) EPC from Corresponding European Application No. 20780291.9, mailed Jul. 16, 2025, all pages.

Final Rejection from corresponding Japanese Application No. 2024-190561, mailed Dec. 9, 2025, all pages.

Notice of Reasons for Rejection from corresponding Japanese Application No. 2024-190561, mailed Aug. 26, 2025, all pages.

* cited by examiner

SYSTEM AND METHOD OF AEROSOL DELIVERY

PRIORITY CLAIM

The present application is a National Phase entry of PCT Application No. PCT/GB2020/052250, filed Sep. 17, 2020, which claims priority from GB Application No. 1914952.5, filed Oct. 16, 2019, each of which is hereby fully incorporated herein by reference.

TECHNICAL FIELD

The present disclosure relates to a system and method of aerosol delivery.

BACKGROUND

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present disclosure.

Electronic aerosol provision systems such as electronic cigarettes (e-cigarettes) generally contain a reservoir of a source liquid containing a formulation, typically including nicotine, from which an aerosol is generated, e.g. through heat vaporization. An aerosol source for an aerosol provision system may thus comprise a heater having a heating element arranged to receive source liquid from the reservoir, for example through wicking/capillary action. Other source materials may be similarly heated to create an aerosol, such as botanical matter, or a gel comprising an active ingredient and/or flavoring. Hence more generally, the e-cigarette may be thought of as comprising or receiving a payload for heat vaporization.

While a user inhales on the device, electrical power is supplied to the heating element to vaporize the aerosol source (a portion of the payload) in the vicinity of the heating element, to generate an aerosol for inhalation by the user. Such devices are usually provided with one or more air inlet holes located away from a mouthpiece end of the system. When a user sucks on a mouthpiece connected to the mouthpiece end of the system, air is drawn in through the inlet holes and past the aerosol source. There is a flow path connecting between the aerosol source and an opening in the mouthpiece so that air drawn past the aerosol source continues along the flow path to the mouthpiece opening, carrying some of the aerosol from the aerosol source with it. The aerosol-carrying air exits the aerosol provision system through the mouthpiece opening for inhalation by the user.

Usually an electric current is supplied to the heater when a user is drawing/inhaling on the device. Typically, the electric current is supplied to the heater, e.g. resistance heating element, in response to either the activation of an airflow sensor along the flow path as the user inhales/draw/puffs or in response to the activation of a button by the user. The heat generated by the heating element is used to vaporize a formulation. The released vapor mixes with air drawn through the device by the inhaling consumer and forms an aerosol. Alternatively or in addition, the heating element is used to heat but typically not burn a botanical such as tobacco, to release active ingredients thereof as a vapor/aerosol.

The amount of vaporized/aerosolized payload inhaled by the user will depend at least in part on how long and how deeply the user inhales and, over a period of time, how frequently the user inhales as well. In turn, these user behaviors may be influenced by their mood.

Embodiments of the present disclosure aim to improve the delivery of the payload to a user whose consumption may be influenced by their mood.

SUMMARY

In one aspect of the present disclosure, a computing device is operable to communicate with an aerosol provision device. The computing device is configured to obtain at least part of a data set, the data set comprising data indicative of a mood of a user of the aerosol provision device as a function of a predetermined variable, calculate, on the basis of at least part of the data and a current value of the predetermined variable, an adjustment to one or more operational parameters for controlling the operation of an aerosol provision device of the user, and provide the calculated adjustment of the one or more operational parameters to the aerosol provision device of the user.

In embodiments, the at least part of a data set is a plurality of data sets including two or more data sets comprising data indicative of a mood of the user of the aerosol provision device as a function of a respective predetermined variable. In such embodiments, the adjustment can be calculated on the basis of at least part of the two or more data sets and a current value of at least one respective predetermined variable. In some embodiments, the plurality of data sets comprise data indicative of a mood of the user as a function of a respective predetermined variable and the adjustment is calculated on the basis of at least part of two or more of the plurality of data sets and a current value of the two or more corresponding respective predetermined variables.

In embodiments, the predetermined variable is one or more of the weather, user facial expression, user voice stress, phone usage, keyword detection, time, and location.

In one aspect of the present disclosure, a system comprises the computing device described above and an aerosol provision system configured to generate aerosol from an aerosol generating material for user inhalation.

In embodiments, the system further comprises one or more of a barometer, a network link to a local weather data source, a camera facing the user in normal use, a microphone proximate to the user in normal use, a keyword detection application, a fitness tracking wearable, a global positioning system receiver, and a clock.

In embodiments, the aerosol provision system comprises a receiver operable to receive the calculated adjustment from the computing device and the computing device is located within one or more of a remote server operable to communicate with the aerosol provision system, a mobile computing device operable to communicate with the aerosol provision system, and a remote server operable to communicate with a mobile computing device operable to communicate with the aerosol provision system. In some embodiments, the computing device is located within the aerosol provision system.

In embodiments, the aerosol provision system is operable to modify the one or more operational parameters responsive to the received calculated adjustment. In embodiments, a separate modification is made to the one or more operational parameters of the aerosol provision system responsive to other data.

In one aspect of the present disclosure, a method of aerosol provision includes obtaining at least part of a data set, the data set comprising data indicative of a mood of a user of the aerosol provision device as a function of a predetermined variable, calculating, on the basis of at least part of the obtained data and a current value of the predetermined variable, an adjustment to one or more operational parameters for controlling the operation of an aerosol provision device of the user, and providing the calculated adjustment of the one or more operational parameters to the aerosol provision device of the user.

It is to be understood that both the foregoing general summary of the disclosure and the following detailed description are provided for the purposes of example, and are not intended to be restrictive of the disclosure. Further aspects are provided in accordance with the claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
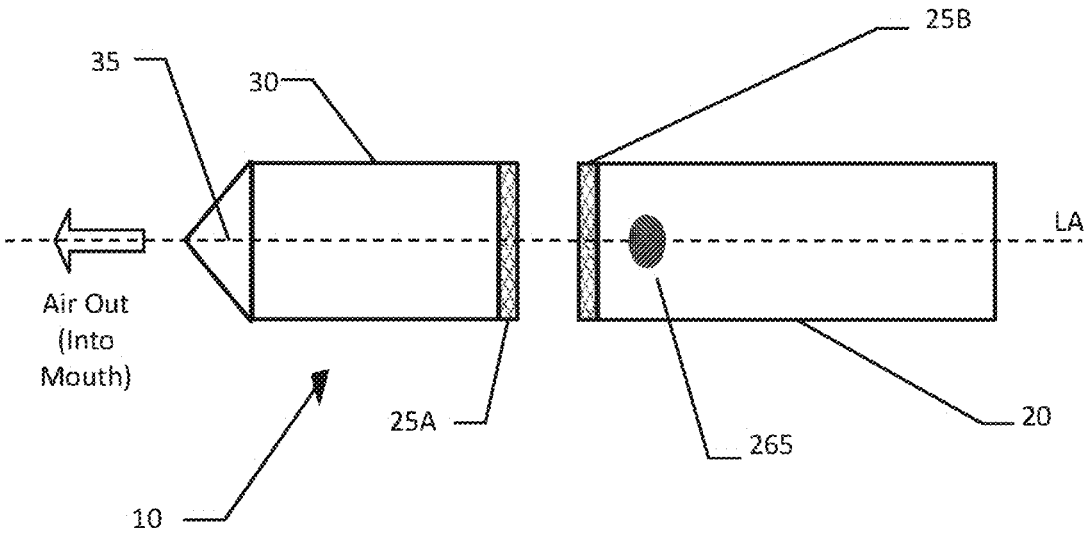
FIG. 1 is a schematic diagram depicting an electronic aerosol/vapor provision system (EVPS), according to an embodiment.

An electronic aerosol provision system and method are disclosed. In the following description, a number of specific details are presented in order to provide a thorough understanding of the embodiments of the present disclosure. It will be apparent, however, to a person skilled in the art that these specific details need not be employed to practice embodiments of the present disclosure. Conversely, specific details known to the person skilled in the art are omitted for the purposes of clarity where appropriate.

As described above, the present disclosure relates to an aerosol provision system (e.g. a non-combustible aerosol provision system) or electronic vapor provision system (EVPS), such as an e-cigarette. Throughout the following description the term "e-cigarette" is sometimes used but this term may be used interchangeably with (electronic) aerosol/vapor provision system. Similarly the terms 'vapor' and 'aerosol' are referred to equivalently herein.

Generally, the electronic vapor/aerosol provision system may be an electronic cigarette, also known as a vaping device or electronic nicotine delivery system (END), although it is noted that the presence of nicotine in the aerosolizable material is not a requirement. In some embodiments, a non-combustible aerosol provision system is a tobacco heating system, also known as a heat-not-burn system. In some embodiments, the non-combustible aerosol provision system is a hybrid system to generate aerosol using a combination of aerosolizable materials, one or a plurality of which may be heated. Each of the aerosolizable materials may be, for example, in the form of a solid, liquid or gel and may or may not contain nicotine. In some embodiments, the hybrid system comprises a liquid or gel aerosolizable material and a solid aerosolizable material. The solid aerosolizable material may comprise, for example, tobacco or a non-tobacco product. Meanwhile in some embodiments, the non-combustible aerosol provision system generates a vapor/aerosol from one or more such aerosolizable materials.

Typically, the non-combustible aerosol provision system may comprise a non-combustible aerosol provision device and an article for use with the non-combustible aerosol provision system. However, it is envisaged that articles which themselves comprise a means for powering an aerosol-generating component may themselves form the non-combustible aerosol provision system. In one embodiment, the non-combustible aerosol provision device may comprise a power source and a controller. The power source may be an electric power source or an exothermic power source. In one embodiment, the exothermic power source comprises a carbon substrate, which may be energized so as to distribute power in the form of heat to an aerosolizable material or heat transfer material in proximity to the exothermic power source. In one embodiment, the power source, such as an exothermic power source, is provided in the article so as to form the non-combustible aerosol provision. In one embodiment, the article for use with the non-combustible aerosol provision device may comprise an aerosolizable material.

In some embodiments, the aerosol-generating component is a heater capable of interacting with the aerosolizable material so as to release one or more volatiles from the aerosolizable material to form an aerosol. In one embodiment, the aerosol-generating component is capable of generating an aerosol from the aerosolizable material without heating. For example, the aerosol-generating component may be capable of generating an aerosol from the aerosolizable material without applying heat thereto, for example via one or more of vibrational, mechanical, pressurization or electrostatic means.

In some embodiments, the aerosolizable material may comprise an active material, an aerosol forming material and optionally one or more functional materials. The active material may comprise nicotine (optionally contained in tobacco or a tobacco derivative) or one or more other non-olfactory physiologically active materials. A non-olfactory physiologically active material is a material, which is included in the aerosolizable material in order to achieve a physiological response other than olfactory perception. The aerosol forming material may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate. The one or more functional materials may comprise one or more of flavors, carriers, pH regulators, stabilizers, and/or antioxidants.

In some embodiments, the article for use with the non-combustible aerosol provision device may comprise aerosolizable material or an area for receiving aerosolizable material. In one embodiment, the article for use with the non-combustible aerosol provision device may comprise a mouthpiece. The area for receiving aerosolizable material may be a storage area for storing aerosolizable material. For example, the storage area may be a reservoir. In one embodiment, the area for receiving aerosolizable material may be separate from, or combined with, an aerosol-generating area.

Referring now to the drawings, wherein like reference numerals designate identical or corresponding parts throughout the several views.

FIG. 1 is a schematic diagram of an electronic vapor/aerosol provision system such as an e-cigarette 10 in accordance with some embodiments of the disclosure (not to scale). The e-cigarette has a generally cylindrical shape, extending along a longitudinal axis indicated by dashed line LA, and comprises two main components, namely a body 20 and a cartomizer 30. The cartomizer includes an internal chamber containing a reservoir of a payload such as for example a liquid comprising nicotine, a vaporizer (such as a heater), and a mouthpiece 35. References to 'nicotine' hereafter will be understood to be merely exemplary and can be substituted with any suitable active ingredient. References to 'liquid' as a payload hereafter will be understood to be merely exemplary and can be substituted with any suitable payload such as botanical matter (for example tobacco that is to be heated rather than burned), or a gel comprising an active ingredient and/or flavoring. The reservoir may be a foam matrix or any other structure for retaining the liquid until such time that it is required to be delivered to the vaporizer. In the case of a liquid/flowing payload, the vaporizer is for vaporizing the liquid, and the cartomizer 30 may further include a wick or similar facility to transport a small amount of liquid from the reservoir to a vaporizing location on or adjacent the vaporizer. In the following, a heater is used as a specific example of a vaporizer. However, it will be appreciated that other forms of vaporizer (for example, those which utilize ultrasonic waves) could also be used and it will also be appreciated that the type of vaporizer used may also depend on the type of payload to be vaporized.

The body 20 includes a re-chargeable cell or battery to provide power to the e-cigarette 10 and a circuit board for generally controlling the e-cigarette. When the heater receives power from the battery, as controlled by the circuit board, the heater vaporizes the liquid and this vapor is then inhaled by a user through the mouthpiece 35. In some specific embodiments, the body is further provided with a manual activation device 265, e.g. a button, switch, or touch sensor located on the outside of the body.

The body 20 and cartomizer 30 may be detachable from one another by separating in a direction parallel to the longitudinal axis LA, as shown in FIG. 1, but are joined together when the device 10 is in use by a connection, indicated schematically in FIG. 1 as 25A and 25B, to provide mechanical and electrical connectivity between the body 20 and the cartomizer 30. The electrical connector 25B on the body 20 that is used to connect to the cartomizer 30 also serves as a socket for connecting a charging device (not shown) when the body 20 is detached from the cartomizer 30. The other end of the charging device may be plugged into a USB socket to re-charge the cell in the body 20 of the e-cigarette 10. In other implementations, a cable may be provided for direct connection between the electrical connector 25B on the body 20 and a USB socket.

The e-cigarette 10 is provided with one or more holes (not shown in FIG. 1) for air inlets. These holes connect to an air passage through the e-cigarette 10 to the mouthpiece 35. When a user inhales through the mouthpiece 35, air is drawn into this air passage through the one or more air inlet holes, which are suitably located on the outside of the e-cigarette. When the heater is activated to vaporize the nicotine from the cartridge, the airflow passes through, and combines with, the generated vapor, and this combination of airflow and generated vapor then passes out of the mouthpiece 35 to be inhaled by a user. Except in single-use devices, the cartomizer 30 may be detached from the body 20 and disposed of when the supply of liquid is exhausted (and replaced with another cartomizer if so desired).

It will be appreciated that the e-cigarette 10 shown in FIG. 1 is presented by way of example, and various other implementations can be adopted. For example, in some embodiments, the cartomizer 30 is provided as two separable components, namely a cartridge comprising the liquid reservoir and mouthpiece (which can be replaced when the liquid from the reservoir is exhausted), and a vaporizer comprising a heater (which is generally retained). As another example, the charging facility may connect to an additional or alternative power source, such as a car cigarette lighter.

Figure 2:
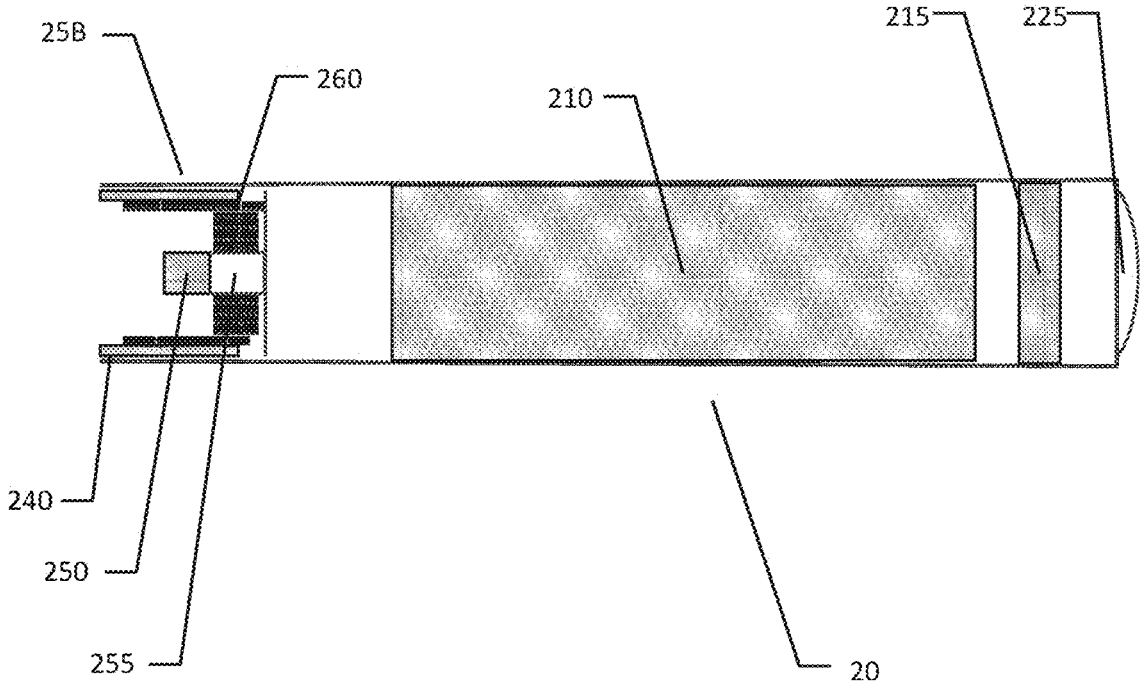
FIG. 2 is a schematic diagram depicting further details of the EVPS of FIG. 1.

FIG. 2 is a schematic (simplified) diagram of the body 20 of the e-cigarette 10 of FIG. 1 in accordance with some embodiments of the disclosure. FIG. 2 can generally be regarded as a cross-section in a plane through the longitudinal axis LA of the e-cigarette 10. Note that various components and details of the body, e.g. such as wiring and more complex shaping, have been omitted from FIG. 2 for reasons of clarity.

The body 20 includes a battery or cell 210 for powering the e-cigarette 10 in response to a user activation of the device. Additionally, the body 20 includes a control unit (not shown in FIG. 2), for example a chip such as an application specific integrated circuit (ASIC) or microcontroller, for controlling the e-cigarette 10. The microcontroller or ASIC includes a CPU or micro-processor. The operations of the CPU and other electronic components are generally controlled at least in part by software programs running on the CPU (or other component). Such software programs may be stored in non-volatile memory, such as ROM, which can be integrated into the microcontroller itself, or provided as a separate component. The CPU may access the ROM to load and execute individual software programs as and when required. The microcontroller also contains appropriate communications interfaces (and control software) for communicating as appropriate with other devices in the body 10.

The body 20 further includes a cap 225 to seal and protect the far (distal) end of the e-cigarette 10. Typically, there is an air inlet hole provided in or adjacent to the cap 225 to allow air to enter the body 20 when a user inhales on the mouthpiece 35. The control unit or ASIC may be positioned alongside or at one end of the battery 210. In some embodiments, the ASIC is attached to a sensor unit 215 to detect an inhalation on mouthpiece 35 (or alternatively the sensor unit 215 may be provided on the ASIC itself). An air path is provided from the air inlet through the e-cigarette, past the airflow sensor 215 and the heater (in the vaporizer or cartomizer 30), to the mouthpiece 35. Thus, when a user inhales on the mouthpiece of the e-cigarette, the CPU detects such inhalation based on information from the airflow sensor 215.

At the opposite end of the body 20 from the cap 225 is the connector 25B for joining the body 20 to the cartomizer 30. The connector 25B provides mechanical and electrical connectivity between the body 20 and the cartomizer 30. The connector 25B includes a body connector 240, which is metallic (silver-plated in some embodiments) to serve as one terminal for electrical connection (positive or negative) to the cartomizer 30. The connector 25B further includes an electrical contact 250 to provide a second terminal for electrical connection to the cartomizer 30 of opposite polarity to the first terminal, namely body connector 240. The electrical contact 250 is mounted on a coil spring 255. When the body 20 is attached to the cartomizer 30, the connector 25A on the cartomizer 30 pushes against the electrical contact 250 in such a manner as to compress the coil spring in an axial direction, i.e. in a direction parallel to (co-aligned with) the longitudinal axis LA. In view of the resilient nature of the spring 255, this compression biases the spring 255 to expand, which has the effect of pushing the electrical contact 250 firmly against connector 25A of the cartomizer 30, thereby helping to ensure good electrical connectivity between the body 20 and the cartomizer 30. The body connector 240 and the electrical contact 250 are separated by a trestle 260, which is made of a non-conductor (such as plastic) to provide good insulation between the two electrical terminals. The trestle 260 is shaped to assist with the mutual mechanical engagement of connectors 25A and 25B.

As mentioned above, a button 265, which represents a form of manual activation device 265, may be located on the outer housing of the body 20. The button 265 may be implemented using any appropriate mechanism, which is operable to be manually activated by the user—for example, as a mechanical button or switch, a capacitive or resistive touch sensor, and so on. It will also be appreciated that the manual activation device 265 may be located on the outer housing of the cartomizer 30, rather than the outer housing of the body 20, in which case, the manual activation device 265 may be attached to the ASIC via the connections 25A, 25B. The button 265 might also be located at the end of the body 20, in place of (or in addition to) cap 225.

Figure 3:
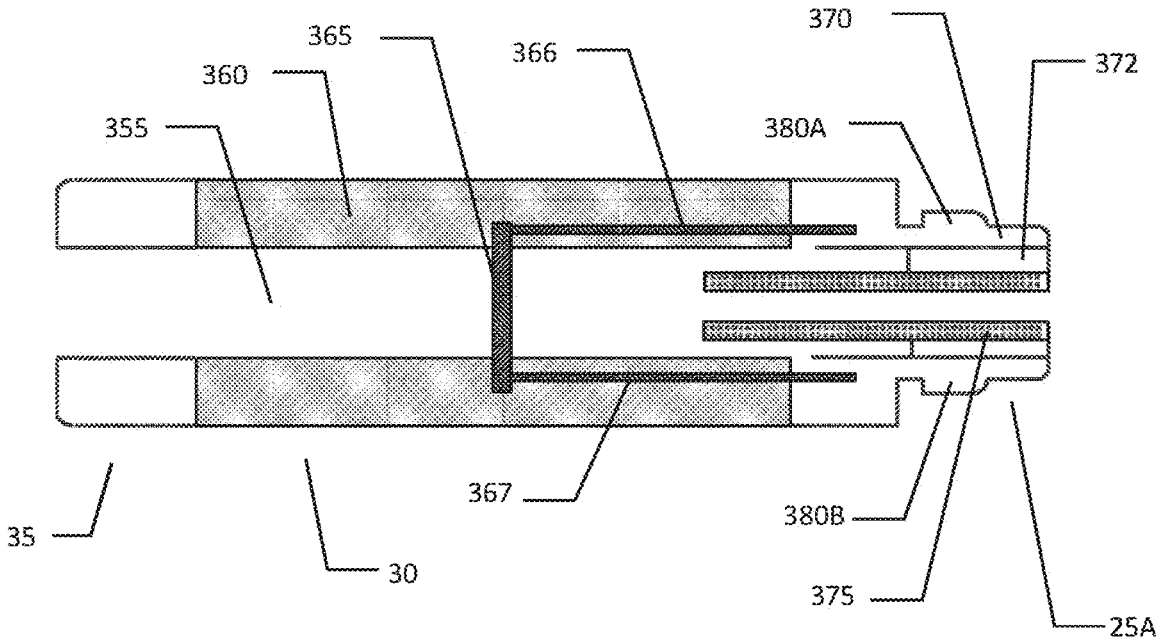
FIG. 3 is a schematic diagram depicting further details of the EVPS of FIG. 1.

FIG. 3 is a schematic diagram of the cartomizer 30 of the e-cigarette 10 of FIG. 1 in accordance with some embodiments of the disclosure. FIG. 3 can generally be regarded as a cross-section in a plane through the longitudinal axis LA of the e-cigarette 10. Note that various components and details of the cartomizer 30, such as wiring and more complex shaping, have been omitted from FIG. 3 for reasons of clarity.

The cartomizer 30 includes an air passage 355 extending along the central (longitudinal) axis of the cartomizer 30 from the mouthpiece 35 to the connector 25A for joining the cartomizer 30 to the body 20. A reservoir of liquid 360 is provided around the air passage 335. This reservoir 360 may be implemented, for example, by providing cotton or foam soaked in liquid. The cartomizer 30 also includes a heater 365 for heating liquid from reservoir 360 to generate vapor to flow through air passage 355 and out through mouthpiece 35 in response to a user inhaling on the e-cigarette 10. The heater 365 is powered through lines 366 and 367, which are in turn connected to opposing polarities (positive and negative, or vice versa) of the battery 210 of the main body 20 via connector 25A (the details of the wiring between the power lines 366 and 367 and connector 25A are omitted from FIG. 3).

The connector 25A includes an inner electrode 375, which may be silver-plated or made of some other suitable metal or conducting material. When the cartomizer 30 is connected to the body 20, the inner electrode 375 contacts the electrical contact 250 of the body 20 to provide a first electrical path between the cartomizer 30 and the body 20. In particular, as the connectors 25A and 25B are engaged, the inner electrode 375 pushes against the electrical contact 250 so as to compress the coil spring 255, thereby helping to ensure good electrical contact between the inner electrode 375 and the electrical contact 250.

The inner electrode 375 is surrounded by an insulating ring 372, which may be made of plastic, rubber, silicone, or any other suitable material. The insulating ring is surrounded by the cartomizer connector 370, which may be silver-plated or made of some other suitable metal or conducting material. When the cartomizer 30 is connected to the body 20, the cartomizer connector 370 contacts the body connector 240 of the body 20 to provide a second electrical path between the cartomizer 30 and the body 20. In other words, the inner electrode 375 and the cartomizer connector 370 serve as positive and negative terminals (or vice versa) for supplying power from the battery 210 in the body 20 to the heater 365 in the cartomizer 30 via supply lines 366 and 367 as appropriate.

The cartomizer connector 370 is provided with two lugs or tabs 380A, 380B, which extend in opposite directions away from the longitudinal axis of the e-cigarette 10. These tabs are used to provide a bayonet fitting in conjunction with the body connector 240 for connecting the cartomizer 30 to the body 20. This bayonet fitting provides a secure and robust connection between the cartomizer 30 and the body 20, so that the cartomizer and body are held in a fixed position relative to one another, with minimal wobble or flexing, and the likelihood of any accidental disconnection is very small. At the same time, the bayonet fitting provides simple and rapid connection and disconnection by an insertion followed by a rotation for connection, and a rotation (in the reverse direction) followed by withdrawal for disconnection. It will be appreciated that other embodiments may use a different form of connection between the body 20 and the cartomizer 30, such as a snap fit or a screw connection.

Figure 4:
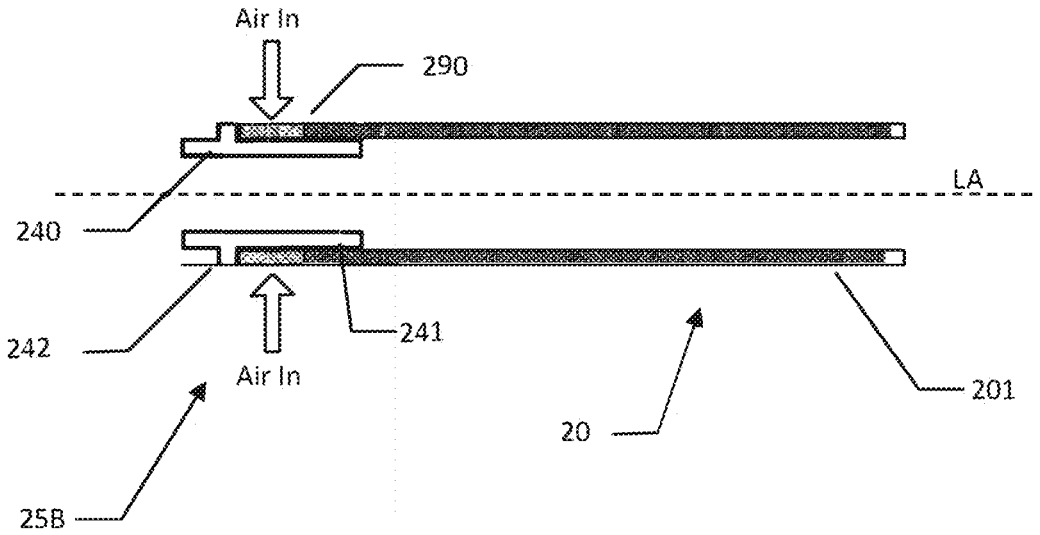
FIG. 4 is a schematic diagram depicting further details of the EVPS of FIG. 1.

FIG. 4 is a schematic diagram of certain details of the connector 25B at the end of the body 20 in accordance with some embodiments of the disclosure (but omitting for clarity most of the internal structure of the connector as shown in FIG. 2, such as trestle 260). In particular, FIG. 4 shows the external housing 201 of the body 20, which generally has the form of a cylindrical tube. This external housing 201 may comprise, for example, an inner tube of metal with an outer covering of paper or similar. The external housing 201 may also comprise the manual activation device 265 (not shown in FIG. 4) so that the manual activation device 265 is easily accessible to the user.

The body connector 240 extends from this external housing 201 of the body 20. The body connector 240 as shown in FIG. 4 comprises two main portions, a shaft portion 241 in the shape of a hollow cylindrical tube, which is sized to fit just inside the external housing 201 of the body 20, and a lip portion 242 which is directed in a radially outward direction, away from the main longitudinal axis (LA) of the e-cigarette. Surrounding the shaft portion 241 of the body connector 240, where the shaft portion does not overlap with the external housing 201, is a collar or sleeve 290, which is again in a shape of a cylindrical tube. The collar 290 is retained between the lip portion 242 of the body connector 240 and the external housing 201 of the body, which together prevent movement of the collar 290 in an axial direction (i.e. parallel to axis LA). However, collar 290 is free to rotate around the shaft portion 241 (and hence also axis LA).

As mentioned above, the cap 225 is provided with an air inlet hole to allow air to flow when a user inhales on the mouthpiece 35. However, in some embodiments the majority of air that enters the device when a user inhales flows through collar 290 and body connector 240 as indicated by the two arrows in FIG. 4.

Figure 5:
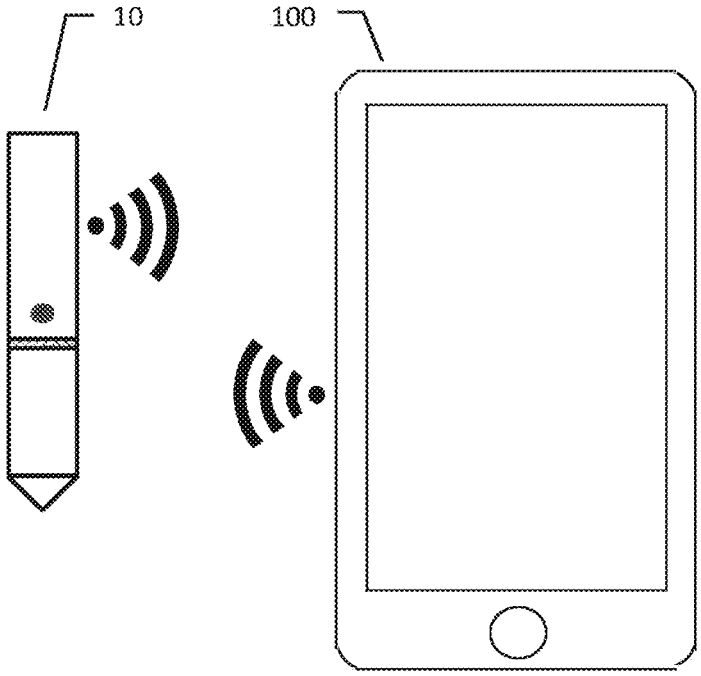
FIG. 5 is a schematic diagram depicting a system comprising the EVPS of FIG. 1 and a remote device, according to an embodiment.

Referring now to FIG. 5, in an embodiment of the present disclosure a system to provide a more responsive electronic vapor provision system (EVPS) may comprise two components, such as an EVPS/e-cigarette 10 and a mobile phone or similar device (such as a tablet) 100 operable to communicate with the e-cigarette (for example to at least receive data from the e-cigarette), for example via Bluetooth®. In this case, the phone provides wider data gathering and processing capability to generate the responsiveness as described later herein.

However, it will be appreciated that whilst the use of two such components is likely, it is also envisaged that an EVPS/e-cigarette with suitable communication and/or user interface capabilities may implement such a system by itself.

In any event, a computing device is provided for use with an aerosol provision system configured to generate aerosol from an aerosol-generating material for user inhalation (e.g. by means of a remote device such a mobile phone or a server, or by means of suitable components within the EVPS itself).

In an embodiment of the present disclosure, the computing device is adapted to provide an adjustment to one or more operational parameters of an aerosol provision system (electronic vapor provision system EVPS), responsive to an estimated mood of the user. In this way, the user may obtain more utility from their EVPS, for example by having it deliver more active ingredient when the user is stressed, and/or less active ingredient and/or more flavoring when the user is relaxed. Other examples are discussed later herein.

Accordingly, in an embodiment of the present disclosure a computing device configured to communicate with an aerosol provision device, the computing device being configured to:

i. obtain a data set, the data set comprising data indicative of a mood of a user of the aerosol provision device as a function of a predetermined variable;

ii. calculate, on the basis of at least part of the obtained data and a current value of the predetermined variable, an adjustment to one or more operational parameters for controlling the operation of an aerosol provision device of the user; and iii. provide the calculated adjustment of the one or more operational parameters to the aerosol provision device of the user.

Optionally, the computing device may be configured to obtain a plurality of data sets rather than just one, with at least one data set comprising data indicative of a mood of the user of the aerosol provision device as a function of a respective predetermined variable; and calculate the adjustment, on the basis of at least part of two or more of the plurality of obtained data sets and a current value of at least one respective predetermined variable.

A data set indicative of the mood of the user may be either be directly indicative of the user's mood (for example based on their facial expression) or relate to external circumstances likely to impact on the users mood (such as for example local weather). Hence, the predetermined variable in each data set may relate to their facial expression or the weather.

Notably, this data set does not relate to the user's use of the EVPS, in terms of inhalation behavior (e.g. timing, frequency, depth of inhalation etc.,) or modification of the device in relation to this (for example by altering a temperature setting or setting of the device), although of course these could be the subject of a separate tracking and adjustment system that may operate separately or in conjunction with the system described herein, but which is outside the scope of the present application.

More generally, data sets indicative of the mood of the user may fall into one of four categories:

i. data relating to the current physical state of the user;

ii. data relating to user originating circumstances; and iii. data relating to external circumstances.

Whilst the first category may comprise data relating to a physiological aspect of the user, the second and third categories will not. Typically the use of such data sets will require or benefit from the user's informed consent, in part because if the user knows that a certain circumstance may contribute towards an improved experience with their EVPS, they are likely to be more willing to provide information about such circumstances back to the computing device.

i. Data Relating to the Current Physical State of the User:

A first example of this category of data includes behavioral data of the user: for example the user may simply fiddle or toy with the EVPS, or hold it in their hand rather than in a bag; it will be appreciated that these activities do not relate to the delivery of vapor to the user but rather are indicative of habits or behaviors of the user. Therefore, these do not relate to usage of the aerosol provision system in the sense of using it to deliver a vapor to the user.

However, it will be understood that there may nevertheless be clear correlations between taking the EVPS out of a bag, or starting to toy with it rather than simply holding it, and a subsequent usage of the EVPS in terms of inhalation. For example, if the EVPS has been in a bag this may be indicative that it has not been used for a while, and so taking it out of the bag may correlate with boredom and a desire to use the device comparatively more frequently than normal in the short term. Meanwhile toying with the EVPS rather than merely holding it may correlate with a state of agitation, and indicate a higher than average rate or depth of inhalation.

Other examples of this category of data include other factors such as the user's facial expression, tone of voice/voice stress or vocabulary/keyword detection (for example as captured by a mobile phone or digital assistant, potentially during other uses, such as during a phone call), each of which either individually or in combination may also correlate with different moods.

Similarly, other interactions indicative of mood may also be considered for other devices, including the computing device itself or other devices potentially in communication with the computing device, such as toying with their mobile phone, or not interacting with the keyboard or mouse of their workstation for a threshold period of time.

Other examples of this data includes physiological data that may be obtained from a fitness tracker worn by the user, such as information about sleep cycles—for example the timing, duration, and/or quality of the previous night's sleep may be indicative of a particular mood or a biasing toward negative mood. Similarly, the user's recent and/or current heart rate, and a step count, impact (accelerometer) measurements or other indicators of exertion may be captured.

Any one or more of these data types may be provided in a further data set. Moreover, a plurality of data sets may be provided, for example corresponding to different sources such as motion tracking from the EVPS itself, user facial expression/speech from the mobile phone, and sleep data/heart rate from a fitness wearable. These may be treated as separate data sets, or amalgamated into one data set by the computing device.

ii. Data Relating to User Originating Circumstances:

Examples of this data include user-initiated activities, such as eating, commuting, working, exercising and the like. Activities such as working or exercising may be detected based on the user's location with respect to a registered work site or gym. Commuting may be detected based on the user's movement as well as optionally their position (for example distinguishing between road and rail travel). This information may be determined from a combination of GPS data from a mobile phone, and optionally additional data, either available publicly in the case of road and rail locations or privately in the case of personal details registered by the user, for example as part of an on-line account associated with the management of their EVPS.

Similarly, social and other engagements may be determined with reference to a user's calendar on their phone.

It will be appreciated again that there may be correlations between the user's mood and data relating to user-originating circumstances such as exercising, commuting or going to a party.

iii. Data Relating to External Circumstances.

Examples of this data include any broader environmental influence on the user's mood or activities that is not directly (or deliberately) caused/arranged by the user themselves. As an example of an environmental condition, a likely influence on the user is the local weather, currently and/or in the near future. Other factors may include for example sports results or news headlines in media consumed by the user (for example based on their observed newsfeed from a social media portal). Other factors that may influence a user's mood and behavior include their current bank balance and/or levels of spending, how recently they received a call from a friend or family member, their relationship status and the like.

Such external data may be collated by the mobile phone; for example, weather data may be obtained from any suitable on-line source and/or any suitable weather service app on the phone. Similarly, sports and news and other social media influences may be obtained from any suitable on-line source and/or any suitable social media app on the phone. Similarly bank data or a general assessment of liquidity may be obtained with the user's permission from a suitable app, or may be provided by the user through a user interface, for example on a weekly basis. Relationship statuses may be obtained via social media, and phone logs, SMS messages and the like may be analyzed for the state of interpersonal relationships with the user's permission.

Again, it will be appreciated that there may be correlations between the user's mood and such external circumstances. For example, heavy rain may significantly reduce the user's happiness, or put another way negatively biased their mood, whilst sunshine may significantly increases their happiness or positively bias their mood. Meanwhile for example a negative news item in a newsfeed may result in a slight increase in stress.

There may also be other sources of data that span these classifications, or represent another broad category, or may be considered to fall outside them altogether. For example, a user originating circumstance may include visiting a doctor, or not visiting the gym at a scheduled/habitual time. These in turn may suggest the user is feeling poorly and hence are also indirect indicators of the physiological state of the user and represent a potential negative bias in mood.

Meanwhile, the time of day or the day of the week are optionally not considered to be suitable data sets; clearly the time of day or the day of the week may have correlations with the mood of the user, but the current time and day of the week per se may be excluded from consideration as a data set in its own right. Nevertheless, the time and day may be used as part of a separate mechanism for establishing habitual usage patterns of the user in parallel with the present disclosure, and these separate approaches may be combined for example by weighting the contribution of usage estimates from these and potentially other techniques to determine an overall adjustment to the operation of the EVPS.

Similarly, location may optionally not be considered to be a suitable data set. Again clearly the location can have a correlation with the mood of the user (as per the example of the trip the doctor herein), but the location per se may be excluded from consideration as a data set in its own right. Nevertheless, location may be used as part of a separate mechanism for establishing habitual usage patterns of the user in parallel with the present disclosure (for example, where the user works at a location where vaping is not permitted), and these separate approaches may be combined for example by weighting the contribution of usage estimates from these and potentially other techniques to determine an overall adjustment to the operation of the EVPS.

As noted previously, moreover a plurality of data sets may be provided in any one or more of these broad categories.

It will be appreciated that some data (for example relating to the user's physiology, preferences or activities—such as their work location) may need to be explicitly provided by the user where not already available (for example the user's physiological data may be available from a partnered fitness app, whilst their work location can be inferred from their location during weekday working hours). Hence optionally the user may be provided with means to input this data to the system, for example by interacting with a website hosted by a service provider associated with the EVPS (for example the manufacturer or a trusted 3rd party) that enables the user to open and maintain an account. The account associates the data with the user and their EVPS, and hence its usage data. The data may include directly input information and/or permissions to access other information (such as social media, a phone calendar, or data from a fitness device). Some such permissions may also be obtained when installing an app on the user's phone.

For the predetermined variable (whether this relates to facial expression, relationship status, local weather report or bank account balance) of any of the above categories, the relevant data set may also include an indication of the likely mood of the user as a function of this variable. This may comprise an indication of a specific mood (for example in relation to facial expression, or keywords in spoken or typed text), or a mood value or bias (e.g. from very positive to very negative).

Hence for example with regards to the weather a mood bias value may be proportional to temperature or may have a different profile, such as being low when too cold or too hot and high when the temperature is pleasant. Similarly, a mood bias value may be proportional to the likelihood of rain, with the bias being low when rain is likely and high when rain is unlikely. Similarly bias is may be considered for cloud cover, pollen, air quality indicators and the like. These mood bias values may be generic (i.e. provided by the manufacturer either at a global, national, or regional level) or may be individual to the user, for example based on feedback provided by the user. Hence for example the aerosol provision system or a companion app on a remote device 100 may provide a happiness scale (for example a series of five faces going from very sad a very happy), and the user can input their level of happiness. Current values of one or predetermined variables may then be correlated with this indicated mood. It will be appreciated that optionally where a mood value for a given predetermined variable value already exists, then such inputs may be used to modify an average value may otherwise be combined with existing value.

Hence typically the or each data set comprises a predetermined variable (whether this is a continuous variable such the temperature, or probability of rain, or a classification value, such as an index of a plurality of facial expressions), together with an associated mood category or mood bias value. It will be appreciated that as described above continuous variables may have a linear or non-linear functional relationship with a mood bias value, but equally may have a relationship with a plurality of mood categories; for example low temperature is may be associated with boredom whilst high temperature is may be associated with fatigue. Alternatively or in addition, high and low temperatures may be associated with negative mood bias values whilst medium temperatures are associated with positive mood bias values. Similarly, classification type variables may have corresponding mood classifications, or associated positive or negative mood bias values. However, the data set may not explicitly associate the user's mood with the variable; the order of variable values may be sufficient, for example to rank from 'good' to 'bad'.

As noted above, the classification and/or mood bias value for a given predetermined variable value may be changed or modified by user input indicative of mood classification or mood value when coincident with the predetermined variable value.

Having obtained the or each data set, then as noted above the computing device is operable to calculate, on the basis of at least part of the obtained data and a current value of the or each predetermined variable, an adjustment to one or more operational parameters for controlling the operation of an aerosol provision device of the user.

It will be appreciated that not all of the obtained data in a given data set may be relevant to the determination of the user's current mood, because a corresponding current value of the or each predetermined variable is not available (for example, the current heart rate may not be available if the user is not wearing their fitness tracker, or a current pollen count may not be available if the user's weather app on their phone does not provide this information).

Similarly data for a particular predetermined variable may be discounted if there is high variability in indicated mood of the user for given values of the variable; for example If a user has provided various different indicators of mood very user interface over time that may have had strong correlations with certain predetermined variables, these may have had little or no correlation for example with pollen count if the user does not have a pollen allergy; as a result, for a particular pollen count range these may have input a variety of happiness values from very unhappy to very happy, or mood categories that vary widely. Where the variance between mood and values of a predetermined variable is high (i.e. the correlation is low), then that predetermined variable, or optionally that value or a localized range of values of that predetermined variable, may not be used when estimating the user's mood.

It will be appreciated for example that a questionnaire or other calibration process for the user may serve to eliminate some categories of input; in this case a question such as "Would you say you have a high/medium/low/no reaction to pollen?" will enable a system to determine whether or not to include the pollen count as a predetermined variable, and/or give some guidance as to a possible contributing weight of influence of that variable where the contribution of multiple variables are considered together.

In any event, given the one or more obtained data sets and the at least part of the obtained data relating a predetermined variable to a mood or mood bias value, then data indicating a current value of the or each predetermined variable may be used to calculate the mood of the user.

Hence, in principle by obtaining data relating to the current physical state of the user, current user originating circumstances, and/or current external circumstances, the corresponding mood, moods or influences on mood can be retrieved and/or calculated.

Hence for example for at least one predetermined variable in at least one data set, and typically for a subset of predetermined variables in a subset of data sets, current values of the predetermined variables are obtainable (for example via weather reports, news feeds, other app and data sources or direct measurements from fitness monitors mobile phone cameras and the like). These values can be used to retrieve the corresponding mood or mood bias value. Individual moods may be assigned a mood value or mood bias value to enable combined operations.

Where multiple variables are being used, the resulting multiple mood or mood bias values may be combined using suitable weightings. These weightings in turn may relate to a correlation between the predetermined variable and the accuracy of predicting mood, based on user feedback or inferred from user behavior. Hence for example if a particular mood as predicted, but the user indicates a contrary mood within a threshold period of time then the contributory waiting of that variable (of that variable at that particular value or localized value range) may be reduced. As noted previously, optionally the relevant data set may also be updated in response to such feedback, enabling the information to become more personalized.

The overall result may be a single mood or mood bias value, or a series of separate mood values or mood bias values. In either case, these may then be associated with corresponding adjustments to one or more operational parameters for controlling the operation of the aerosol provision device.

It will be appreciated that the association between mood or mood bias value and the adjustment of one or more operational parameters implicitly associates a mood or mood value with changes in vaping related behavior, and then adjusts one or more operational parameters of the aerosol provision device to accommodate or anticipate that new vaping related behavior. As such the or each mood or mood value can be seen as a direct or indirect proxy for the operational settings of the aerosol provision device, and vice versa.

For example, boredom may be associated with increasing a flavor component of the generated aerosol, whilst stress or frustration may be associated with increasing an active ingredient component of the generated aerosol, or generating more aerosol per unit volume of air, so as to deliver more active ingredient (all else being equal).

Adjustments may take any suitable form. As noted previously, the amount of vapor/aerosol and hence active ingredient produced by the EVPS is typically a function of the temperature of the heater used to vaporize the payload. Hence as a first example where increased usage is indicated, the effective temperature of the heater may be increased by raising the temperature and/or altering a duty cycle of the heater. Similarly, where decreased usage is indicated, the effective temperature of the heater may be decreased by reducing the temperature and/or altering a duty cycle of the heater. In each case, the delivery of active ingredient by the device will be more in tune with the inferred wishes of the user based on their historic patterns of usage in the face of the currently detected circumstances.

Similarly, the rate of delivery of the payload to the heater/atomizer may be adjustable to similar ends. This may be based on reducing a constriction in a wick, adjusting a valve, or the like.

Other methods can be envisaged, for example in the case of the payload being a gel occupying a surface area adjacent to a multipart heater, then more gel can be vaporized by activating more parts of the heater, and/or by altering the temperature/duty cycle of one or more parts of the heater.

Similarly, where more frequent usage is indicated, then optionally after inhalation the temperature of the heater may be reduced to a level below the vaporization temperature, but not completely turned off, so that the devices more responsive during periods of rapid inhalation. Such an option may be subject to a threshold frequency below which this approach is not used.

Again similarly, where short, sharp inhalations are indicated is likely (for example in stressful circumstances), then a profile of the vapor delivery may attempt to deliver vapor as quickly as possible after activation by raising the temperature of the heater above a normal operating temperature for a predetermined period. This predetermined period may be based on inhalation profiles and the like, and/or responsive to a detected peak airflow during the inhalation. Conversely, where slow, deep inhalations are indicated is likely then a profile of the vapor delivery may be more even. If the system is aware of the nature of the payload, then for example in this case if the payload is strongly flavored then the device may provide a boost in vapor toward the end of the inhalation so as to increase subjective flavor.

In addition to direct adjustment to operational parameters of the vapor generation process, indirect adjustments can be made where the vapor generation process is already subject to other controls. Hence for example if the user has set a maximum usage allowance for the day, then in response to features of a circumstance indicative of heavy use previously then this maximum usage allowance may be increased.

Similarly, if the user is following a reduction program over the course of weeks or months, then in response to features of circumstance indicative of heavy use previously then the reduction program may pause for that day (e.g. not implement a per inhalation or per period active ingredient delivery reduction, or a reduction in total allowance). Conversely, where features of circumstances indicate lighter than average use historically, then optionally the nicotine reduction program may skip forward a day or equivalently further reduction beyond the default daily increment.

Hence, in such cases the operational parameters are adjusted at a predetermined variance to the corresponding usage (i.e. modifying a separately imposed usage regime).

The operational parameters need not be limited to direct or indirect generation of the vapor itself. For example if the EVPS has haptic feedback or other user interface elements, these may be adjusted as appropriate. For example if usage in response to a detected feature of a circumstance is indicative of stress, then haptic feedback may be reduced, and/or other interface elements may be modified, for example to change the color of an indicator light, or reduced the volume or change the type of a notification sound (for example a sound used to indicate the need to change a reservoir). Similarly, a threshold for notifying the user that a payload reservoir is running low may be increased so that notification occurs earlier; this may reduce the chances of the user no longer being able to use their EVPS during a stressful situation. A similar principle may apply to battery life. More generally, the content and/or frequency of device initiated user interface interactions may be altered (for example to reduce or increase the number of status notifications or reminders).

Other modifications will be apparent to the skilled person, both on the EVPS itself and/or optionally on the mobile phone, particularly where this is used as the user interface or extension of it.

Hence, subsequent to the computing device is configured to provide the calculated adjustment of the one or more operational parameters to the aerosol provision device of the user.

This provision may take the form of directly controlling the aerosol provision device, if at least the calculating function of the computing device is located within the aerosol provision device, or alternatively mate in the form of transmitting the adjustment from the computing device (for example located in a mobile phone or a remote server) to the aerosol provision device, either as a command for implementation by a local processor of the aerosol provision device, or as a series of one or parameter settings to be used by the aerosol provision device.

As was noted previously, it will be appreciated that the above description discusses the use of predetermined variables that are themselves unrelated to the act of the vaping, and relating these to a user's mood. The user's mood is considered an implicit proxy of associated mood-driven changes in a user's vaping behavior. Consequently the calculated users mood or mood values are used to drive adjustments in operational parameters of the aerosol provision system that are intended to accommodate/anticipate those changes in behavior.

However, it will be appreciated that it is possible to bypass the intermediate operation of explicitly identifying a mood and/or generating a mood value (e.g. mood bias value) as a preamble to selecting one or operational parameters for adjustment.

If there is a clear correlation between bad weather and a desired increase in flavor and rate of use of the aerosol provision system, then it is not necessary to indicate the intermediate mood, or this may be simply an internal calculation.

In this case, the notional mood values may be simply treated as weightings towards different adjustments of the aerosol provision system, with the value associated with bad weather having a strongly weighted link to increasing flavor, and for example reducing user interface notifications if the frequency of use is likely to increase.

Hence for example a correlator, such as a neural network or other suitable machine learning system may be trained on one or more data sets, which instead of associating one or predetermined variables with one or more mood classifications of values, associates values of one or more predetermined variables with one or more changes in operational parameters of the aerosol provision system, these in turn being proxies for mood as discussed above. Hence, in this case the obtained data sets comprise data indicative of a mood of the user of the aerosol provision system as a function of a predetermined variable by virtue of indicating any change in one or operational parameter that in turn is a proxy for the mood that this change in operation accommodates. To a first approximation, such a correlator may be trained on data derived from a corpus of a plurality of users, to provide a relatively generic correlation.

To a second approximation, users whose circumstances and vaping behavior have been obtained for the purposes of training this correlator may also be asked to complete a questionnaire, for example characterizing their personalities and individual responses (for example in terms of mood and/or vaping habit) to certain circumstances, such as those characterized by the predetermined variables in the data set.

Subsequently, a prospective user of a system implementing the techniques described herein may fill in a similar questionnaire. The system may then select a previously trained correlator that has been trained using a subset of the corpus of users having the most similar questionnaire responses to the current user, so that the responses of the correlator are likely to correctly anticipate the mood-induced changes in behavior of the user. Optionally, a new correlator may be trained based on the data of those users within the corpus of users whose responses to the questionnaire are sufficiently similar (e.g. to within a threshold difference), either in terms of the entire questionnaire or with respect to individual aspects of the questionnaire associated with individual behaviors. In this way a bespoke correlator may be bootstrapped for the individual user whose responses/outputs are likely to still more closely anticipate the mood induced changes in behavior of the user.

The correlator selected or generated for a user may still learn once in use, for example using feedback from the user or comparing actual behavior with predicted behavior, to further refine its model.

Referring again to FIG. 1, the EVPS may be a self-contained unit (commonly referred to as an e-cigarette, even if the device itself does not necessarily conform to the shape or dimensions of a conventional cigarette). Such an e-cigarette may comprise an airflow measuring means, a processing means and optionally one or more feedback means such as haptic, audio and/or light/display means.

Alternatively, referring to FIG. 5, an EVPS system may comprise two components, such as an e-cigarette 10 and a mobile phone or similar device (such as a tablet) 100 operable to communicate with the e-cigarette (for example to at least receive data from the e-cigarette), for example via Bluetooth.

The mobile phone may then comprise the processing means and one or more feedback means such as haptic, audio and/or light/display means, alternatively o in addition to those of the e-cigarette.

Optionally an EVPS system may comprise an e-cigarette 10 operable to communicate with a mobile phone 100, in which the mobile phone stores one or more parameters or other data (such as data characteristic of one or more aspects of usage by the user) for the EVPS, and receives such parameters/data from the e-cigarette. The phone may then optionally perform processing on such parameters/data and either return processed data and/or instructions to the EVPS, display a result to the user (or perform another action) or forward processed and/or unprocessed parameters/data on to a remote server.

Optionally the mobile phone or the EVPS itself may be operable to wirelessly access data associated with an account of the user at such a remote server.

In a variant embodiment of the disclosure, a first EVPS of a user may communicate some or all of its user settings to another EVPS. The user settings may comprise settings related to an implementation of the above-disclosed methods, such as data characteristic of user behavior, and/or data relating to modification of the EVPS operation.

Such data may be relayed between devices either directly (e.g. via a Bluetooth or near-field communication) or via one or more intermediary devices, such as a mobile phone owned by the user of the two devices or a server on which the user has an account.

In this way, a user may easily share the data from one device to another, for example if the user has two EVPS devices, or if the user wishes to replace one EVPS device with another without losing accumulated personalization data.

Optionally in this embodiment, where the second EVPS differs in type from the first EVPS (for example by having a different default power level, or heating efficiency), then a conversion factor or look-up table for converting operational parameters from the first EVPS to the second EVPS may be employed. This may be provided in software or firmware of the second EVPS, and identify the first EVPS and hence the appropriate conversions when making direct communication (or where data is relayed without change via an intermediary such as a phone). Alternatively or in addition, an app on the phone may provide the conversion, optionally downloading the relevant conversions in response to the identity of the first and second EVPS. Again, alternatively or in addition a remote server may provide the conversion, in response to the identity of the first and second EVPS as associated with a user's account.

Hence, alternatively or in addition to an EVPS, a computing device such as a server (or a mobile phone operating in a similar role by itself or in conjunction with such a server) may thus be used to calculate device settings (e.g. adjustments to one or more operational parameters, as described herein), based on received data registered to a user, such as current values of predetermined variables specific to the user as described herein, and/or data initially characterizing the user, such as a questionnaire, that may be used to initially tailor a correlator to that user's likely needs.

It will be appreciated that the methods and techniques described herein may be carried out on conventional hardware suitably adapted as applicable by software instruction or by the inclusion or substitution of dedicated hardware.

Thus the required adaptation to existing parts of a conventional equivalent device may be implemented in the form of a computer program product comprising processor implementable instructions stored on a non-transitory machine-readable medium such as a floppy disk, optical disk, hard disk, solid state disk, PROM, RAM, flash memory or any combination of these or other storage media, or realized in hardware as an ASIC (application specific integrated circuit) or an FPGA (field programmable gate array) or other configurable circuit suitable to use in adapting the conventional equivalent device. Separately, such a computer program may be transmitted via data signals on a network such as an Ethernet, a wireless network, the Internet, or any combination of these or other networks.

Figure 6:
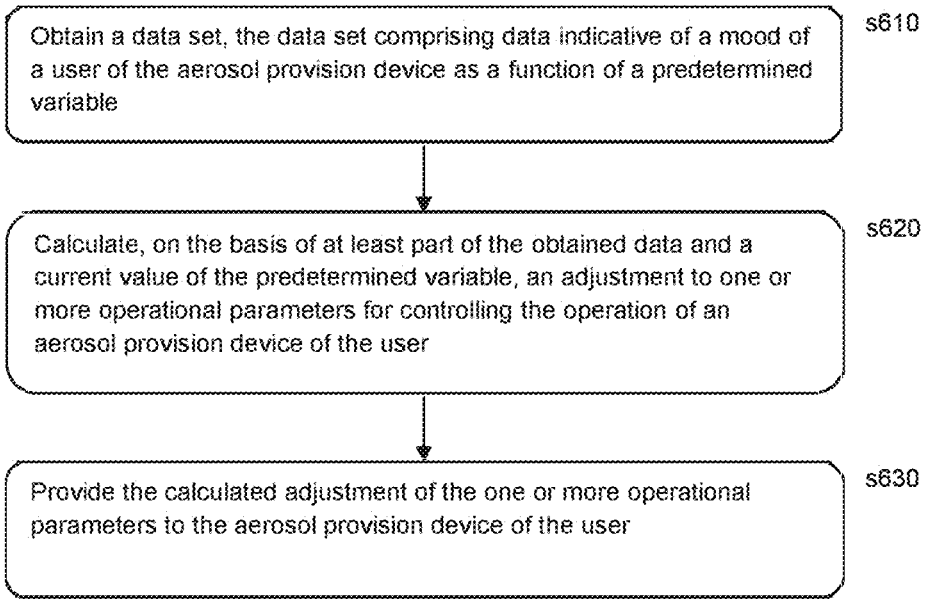
FIG. 6 is a flowchart depicting a method of aerosol delivery, according to an embodiment.

In particular, referring to FIG. 6, a method of aerosol delivery that may be implemented, for example using such conventional hardware, comprises:

- at s610, obtaining at least part of a data set, the data set comprising data indicative of a mood of a user of the aerosol provision device as a function of a predetermined variable;
- at s620, calculating, on the basis of at least part of the obtained data and a current value of the predetermined variable, an adjustment to one or more operational parameters for controlling the operation of an aerosol provision device of the user; and
- at s630, providing the calculated adjustment of the one or more operational parameters to the aerosol provision device of the user.

It will be apparent to a person skilled in the art that variations in the above method corresponding to operation of the various embodiments of the method and/or apparatus as described and claimed herein are considered within the scope of the present disclosure, including but not limited to where:

the obtaining comprises obtaining at least part of a plurality of data sets, at least one data set comprising data indicative of a mood of the user of the aerosol provision device as a function of a respective predetermined variable, and the captivating comprises calculating the adjustment, on the basis of at least part of two or more of the plurality of obtained data sets and a current value of at least one respective predetermined variable;

a plurality of data sets comprise data indicative of a mood of the user as a function of a respective predetermined variable, and the adjustment comprises calculating the adjustment on the basis of at least part of two or more of the plurality of obtained data sets indicative of mood and a current value of the two or more corresponding respective predetermined variables;

a respective predetermined variable is one or more selected from the list consisting of the weather, user facial expression, user voice stress, phone usage, and/or keyword detection, as described previously herein;

an additional respective predetermined variable is one or more selected from the list consisting of time (per se) and location (per se), as described previously herein;

in one instance, the method is implemented on a computing device that is part of a system comprising an aerosol provision system configured to generate aerosol from an aerosol-generating material for user inhalation;

in this instance, the method is implemented on a respective computing device located within one or more selected from the list consisting of a remote server operable to communicate with the aerosol provision system, a mobile computing device operable to communicate with the aerosol provision system, and a remote server operable to communicate with a mobile computing device operable to communicate with the aerosol provision system, and the aerosol provision system comprises a receiver operable to receive the calculated adjustment from the computing device;

in this instance, the computing device is located within the aerosol provision system;

in this instance, the aerosol provision system is operable to modify the one or more operational parameters responsive to the received calculated adjustment (i.e. change its operation/behavior);

and optionally the modification is additional to a separate modification of one or more operational parameters of the aerosol provision system responsive to other data (, either in the form of making additional value changes separately to changes made by other schemes, or providing a separate input to a scheme or supervising scheme that combines contributions from multiple influences on the behavior of the aerosol provision system); and a current value of one or predetermined variables may be obtained using one or more selected from the list consisting of a barometer, a network link to a local weather data source, a camera facing the user in normal use, a microphone proximate to the user in normal use, a keyword detection application, a fitness tracking wearable, a global positioning system receiver, and a clock (where for example these may be provided to the computing device by an associated mobile phone, remote server, wearable device, and/or other peripheral).

The foregoing discussion discloses and describes merely exemplary embodiments of the present disclosure. As will be understood by those skilled in the art, the present disclosure may be embodied in other specific forms without departing from the essential characteristics thereof. Accordingly, the disclosure of the present disclosure is intended to be illustrative, but not limiting of the scope of the disclosure, as well as other claims. The disclosure, including any readily discernible variants of the teachings herein, defines, in part, the scope of the foregoing claim terminology such that no inventive subject matter is dedicated to the public.

The invention claimed is:

1. An aerosol provision device comprising a computing device, the computing device being configured to:

obtain at least part of a data set, the data set comprising data relating to a current physical state of a user as a function of a predetermined variable;

calculate, on the basis of at least part of the data and a current value of the predetermined variable, an adjustment to one or more operational parameters for controlling the operation of an aerosol provision device of the user; and provide the calculated adjustment of the one or more operational parameters to the aerosol provision device of the user, wherein the one or more operational parameters comprise a setting of a heater.

2. The aerosol provision device according to claim 1, wherein the at least part of a data set is a plurality of data sets, the plurality of data sets including two or more data sets comprising data relating to a current physical state of the user of the aerosol provision device as a function of a respective predetermined variable, and the adjustment is calculated on the basis of at least part of the two or more data sets and a current value of at least one respective predetermined variable.

3. The aerosol provision device according to claim 2, wherein the plurality of data sets comprise data relating to a current physical state of the user as a function of a respective predetermined variable, and the adjustment is calculated on the basis of at least part of two or more of the plurality of data sets and a current value of the two or more corresponding respective predetermined variables.

4. The aerosol provision device according to claim 1, in which the predetermined variable is one or more of:

i. the weather;
ii. user facial expression;
iii. user voice stress;
iv. phone usage; and
v. keyword detection.

5. The aerosol provision device according to claim 1, in which the predetermined variable is one or more of:

i. time; and
ii. location.

6. The aerosol provision device according to claim 1, in which the aerosol provision device is an aerosol provision device for an aerosol provision system.

7. The aerosol provision device according to claim 6, in which the aerosol provision system is operable to modify the one or more operational parameters responsive to the received calculated adjustment.

8. The aerosol provision device according to claim 6, further comprising one or more of:

i. a barometer;
ii a network link to a local weather data source;
iii. a camera facing the user in normal use;
iv. a microphone proximate to the user in normal use;

v. a keyword detection application;

vi. a fitness tracking wearable;

vii. a global positioning system receiver; and viii. a clock.

9. The aerosol provision device according to claim 7, in which a separate modification is made to the one or more operational parameters of the aerosol provision system responsive to other data.

10. A method of aerosol provision by an aerosol provision device, comprising:

obtaining, by a computing device of the aerosol provision device, at least part of a data set, the data set comprising data relating to a current physical state of a user of the aerosol provision device as a function of a predetermined variable;

calculating, by the computing device, on the basis of at least part of the obtained data and a current value of the predetermined variable, an adjustment to one or more operational parameters for controlling the operation of an aerosol provision device of the user; and providing, by the computing device, the calculated adjustment of the one or more operational parameters to the aerosol provision device of the user, wherein the one or more operational parameters comprise a setting of a heater.

11. The method according to claim 10, in which the obtaining step comprises obtaining at least part of a plurality of data sets, at least one data set of the plurality of data sets comprising data relating to a current physical state of the user of the aerosol provision device as a function of a respective predetermined variable; and the calculating step comprises calculating the adjustment, on the basis of at least part of two or more of the plurality of data sets and a current value of at least one respective predetermined variable.

12. The method according to claim 11, in which the plurality of data sets comprise data relating to a current physical state of the user as a function of a respective predetermined variable; and the calculating step comprises calculating the adjustment on the basis of at least part of two or more of the plurality of data sets indicative of mood and a current value of the two or more corresponding respective predetermined variables.

13. The method according to claim 10, in which the predetermined variable is one or more of:

i. the weather;

ii. user facial expression;

iii. user voice stress;

iv. phone usage; and v. keyword detection.

14. The method according to claim 10 in which the predetermined variable is one or more of:

i. time; and ii. location.

15. The method according to claim 10, in which the aerosol provision device is operable to modify the one or more operational parameters responsive to the received calculated adjustment.

16. The method according to claim 15, in which a separate modification is made to the one or more operational parameters of the aerosol provision device responsive to other data.

17. The method according to claim 10, in which the current value of the predetermined variable is obtained using one or more of:

i. a barometer;

ii. a network link to a local weather data source;

iii. a camera facing the user in normal use;

iv. a microphone proximate to the user in normal use;

v. a keyword detection application;

vi. a fitness tracking wearable;

vii. a global positioning system receiver; and viii. a clock.

* * * * *